US005107526A

United States Patent [19]

Hoover

[11] Patent Number: 5,107,526

[45] Date of Patent: Apr. 21, 1992

[54] WATER WINDOW IMAGING X-RAY MICROSCOPE

[75] Inventor: Richard B. Hoover, Huntsville, Ala.

[73] Assignee: The United State of America as represented by the Administrator of the National Aeronautics and Space Administration, Washington, D.C.

[21] Appl. No.: 606,988

[22] Filed: Oct. 31, 1990

[51] Int. Cl.[5] ..... G21K 7/00

[52] U.S. Cl. ..... 378/43; 378/210

[58] Field of Search ..... 378/43

[56] References Cited

PUBLICATIONS

"Soft X-Ray Imaging with a Normal Incidence Mirror", Underwood, Nature, vol. 294-3, Dec. 1981, pp. 429-430.

"Layered Synthetic Microstructures Properties and Applications in X-Ray Astronomy", Underwood et al, SPIE, vol. 184, 1979, pp. 123-130.

*Primary Examiner*—Craig E. Church

*Attorney, Agent, or Firm*—Robert L. Broad, Jr.; Jerry L. Seemann; John R. Manning

[57] ABSTRACT

A high resolution x-ray microscope for imaging microscopic structures within biological specimens has an optical system including a highly polished primary and secondary mirror coated with identical multilayer coatings, the mirrors acting at normal incidence. The coatings have a high reflectivity in the narrow wave bandpass between 23.3 and 43.7 angstroms and have low reflectivity outside of this range. The primary mirror has a spherical concave surface and the secondary mirror has a spherical convex surface. The radii of the mirrors are concentric about a common center of curvature on the optical axis of the microscope extending from the object focal plane to the image focal plane. The primary mirror has an annular configuration with a central aperture and the secondary mirror is positioned between the primary mirror and the center of curvature for reflecting radiation through the apertture to a detector. An x-ray filter is mounted at the stage end of the microscope, and film sensitive to x-rays in the desired band width is mounted in a camera at the image plane of the optical system. The microscope is mounted within a vacuum chamber for minimizing the absorption of x-rays in air from a source through the microscope.

20 Claims, 2 Drawing Sheets

WATER WINDOW IMAGING X-RAY MICROSCOPE

ORIGIN OF THE INVENTION

The invention described herein was made by an employee of the United States Government and may be manufactured and used by or for the government for governmental purposes without the payment of any royalties thereon or therefor.

BACKGROUND OF THE INVENTION

This invention relates to x-ray microscopes and more particularly to a narrow bandpass high resolution x-ray microscope for imaging microscopic structures within biological specimens, the bandpass being in the water window wherein x-rays are absorbed by carbon and not absorbed by water within cells and tissues.

The water window is the narrow x-ray band which lies between the K absorption edge of oxygen and the K absorption edge of carbon, the former being 23.3 angstroms and the latter being 43.7 angstroms. X-Rays of wavelength just below the K absorption edge of oxygen are highly absorbed by water, but at wavelengths just above the 23.3 angstrom K absorption edge, water is quite transparent. Similarly, carbon structures are very absorptive to wavelengths just below the carbon K absorption edge of 43.7 angstroms, but transparent at longer wavelengths. Because of these natural properties of the interactions of x-rays with matter, a microscope designed to produce images using x-rays of wavelength lying within the relatively narrow water window would provide a unique instrument ideally suited for ultra-high resolution studies of proteins, cell nuclei, chromosomes and gene structures, DNA and RNA molecules, mitochondria, viruses, cellular golgi apparatus and other carbon based structures within the aqueous environment of living or freshly killed cells. Such a microscope would take specific advantage of the nature and characteristics of x-ray absorption in the immediate vicinity of the K edges of the dominant components within living cells and tissues. It can thus be utilized for medical and microbiological research into the nature and characteristics of DNA and RNA molecules, genetic structures and investigations of proteins, protein crystals, viruses and a host of other microscopic carbon based structures. The value of a microscope permitting images of the important carbon constitutes of microscopic structures should be of immense value in many biological and medical research areas including DNA and RNA research, genetic research, gene splicing, genetic engineering, cancer and AIDS research.

The prior art x-ray microscopes are broad bandpass systems. Thus, they are not capable of yielding high resolution, high contrast images of carbon structures within living cells since x-ray absorption within the water of the cell degrades the contrast and makes it impossible to obtain quality images of the small carbon based structures. These prior art microscopes have been fabricated based upon grazing incidence systems using the principle of the Kirkpatrick-Baez configuration and the Wolter (Hyperboloid-Ellipsoid) configurations. The single Wolter or crossed Kirkpatrick-Baez systems are typically made to operate at a low grazing angle of incidence, e.g., less than one degree and typically are effective reflectors of x-rays of wavelengths greater than 6 angstroms whether or not they are uncoated or coated with a high-Z diffractor material as gold, platinum or iridium Because they are broad bandpass systems an x-ray microscope of the prior art capable of reflecting radiations as short as 23.3 angstroms will also effectively reflect wavelengths much longer than 43.7 angstroms where carbon becomes transparent. Consequently, the prior art microscopes are not suited for research in the critical and relatively narrow band of the electromagnetic spectrum in which the properties of water and carbon, the components most important to living cells, play the dominant role in governing the achievable spatial resolution and contrast. An imaging microscope capable of having the narrow x-ray bandpass of the water window although invaluable to many biological and medical research areas is not known in the prior art.

SUMMARY OF THE INVENTION

Consequently, it is a primary object of the present invention to provide an x-ray microscope capable of imaging and producing ultra-high spatial resolution magnified images of microscopic carbon based structures.

It is another object of the present invention to provide an imaging x-ray microscope having a narrow bandpass in the region of wavelengths in the water window.

It is a further object of the present invention to provide an imaging x-ray microscope for optimizing contrast and maximizing spatial resolution of carbon based microstructures within the aqueous envelope common to living and freshly killed cells.

Accordingly, the present invention provides a high resolution x-ray microscope for imaging microscopic structures within biological specimens, the microscope being configured particularly to take advantage of the nature and characteristics of x-ray absorption in the immediate vicinity of the K edges of the dominant components within living cells and tissues, e.g., carbon, water, hydrogen, oxygen and nitrogen. The microscope thus has an optical system including a highly polished primary and secondary mirror coated with identical multilayer coatings, the mirrors acting at normal incidence. The coatings are designed so as to have a high reflectivity in the narrow bandpass between 23.3 and 43.7 angstroms and having very low reflectivity outside of this wavelength range. In the specific form of the invention the reflecting mirror surfaces are spherical, the primary mirror being concave and the secondary mirror being convex, the mirrors having respective radii of curvature which are concentric about a common center of curvature on the optical axis of the microscopes extending from the object focal plane to the image focal plane. One or more foil x-ray filters may be mounted in the optical path to remove unwanted radiation resulting from certain x-ray sources. A specimen mounted on a filter at the object focal plane will be magnified and imaged in the narrow bandpass onto a detector such as a film at the image focal plane. In order to reduce x-ray absorption in air, the entire apparatus is mounted in a vacuum chamber. Thus, the invention relates to a microscope utilizing specially designed narrow bandpass multilayer coatings (which provide peak reflectivity in the water window) on optics and with thin composite metal foil x-ray filters with properly selected K or L series absorption edges chosen so as to effectively transmit x-rays w the water window and to very effectively reject UV and visible radiation wavelengths outside this important narrow bandpass.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
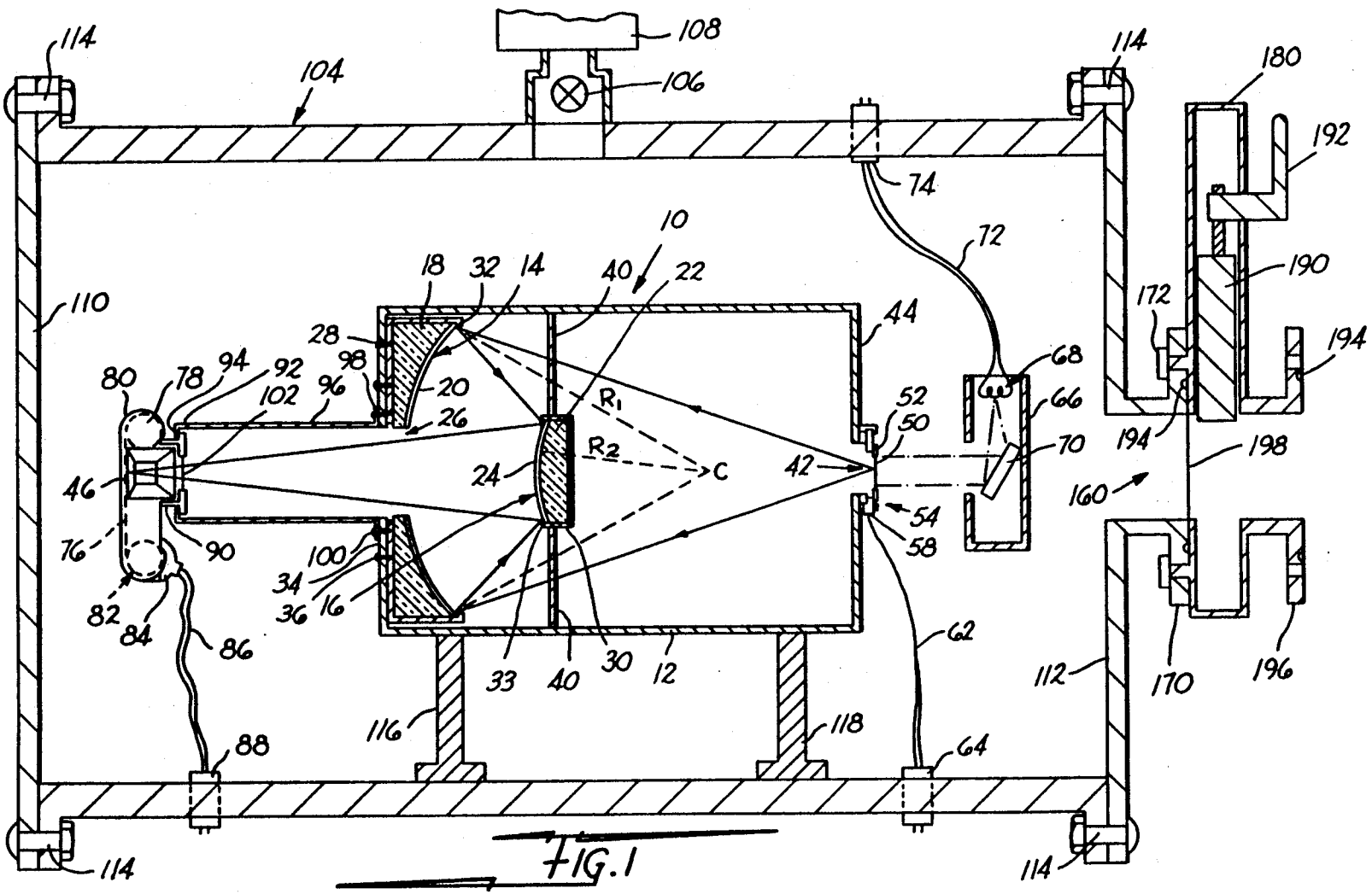
FIG. 1 is a diagrammatic cross sectional view of an x-ray microscope and other apparatus constructed in accordance with the principles of the present invention.

A microscope generally indicated at 10 constructed in accordance with the principles of the present invention includes a hollow housing or mounting tube 12 within which reflecting optics comprising a primary and secondary reflector 14, 16 are mounted. The primary reflector 14 comprises a normal incidence concave spherical primary mirror substrate 18 having a highly polished reflective surface with a multilayer coating 20 applied to the reflecting surface, while the secondary reflector 16 comprises a normal incidence spherical convex mirror substrate 22 having a highly polished reflective surface with a multilayer coating 24 identical to the coating 20 applied to the reflective surface of the secondary mirror, the substrates, surface finish and coatings hereinafter described in detail. The primary mirror substrate 18 is an annular member having a central aperture 26. The mirrors are mounted such that the radius of curvature $R_1$ of the primary mirror and the radius of curvature $R_2$ of the secondary mirror having a common center of curvature C located on the optical axis of the microscope, the optical axis passing through the center of the aperture 26. Thus, the radius of curvature of both spherical mirrors are concentric about the center of curvature C and the radiation after being reflected by the secondary mirror 22 converges through the aperture 26 to the focal plane where the image is formed, i.e., the image plane. The rear surfaces of both mirrors are planar or flat and the mirrors are mounted in respective mountings 28, 30. The primary mirror mounting 28 comprises a substantially hollow cylindrical annular mounting cell within which the mirror 18 is positioned with the flat rear surface and the periphery abutting the interior of the cell, the cell having a small flange 32 at the periphery of the mirror mounting end for constraining the mirror 18 within the cell. The end of the mounting cell 28 remote from the mirror is secured to the imaging end 34 of the mounting tube 12 by means of screws 36 or the like so that the primary mirror is fixed in position. The secondary mirror mounting 30 comprises a substantially hollow cylindrical member within which the secondary mirror is mounted with its flat surface and periphery abutting the interior of the cylindrical member and with the reflecting surface facing toward the image plane, the secondary mirror being held in the mounting by a peripheral flange 33 at the open end of the mounting. One or more, and preferably three or less, very thin rods 40 form a spider for positioning and holding the secondary mounting 30 and thus the secondary mirror 22 in proper position on the optical axis and offer minimal obstruction to the incoming radiation, the rods of the spider being secured to the interior of the mount tube 12 by conventional means such as adhesives or the like. The selection of the radii $R_1$ and $R_2$ of the mirrors 18, 22 together with the positioning of the specimen 42 stage end 44, as hereinafter described, provides the optical configuration of an aplanatic, two spherical mirror microscope constrained by the imposition of the Schwarzschild condition so as to prevent aberrations, i.e., $R_2/R_1=1.5-R_2/Z_0\pm(1.25-R_2/Z_0)^{\frac{1}{2}}$ wherein $Z_0$ is the distance along the optical axis he center of curvature C to the specimen.

The reflecting surfaces 20, 24 of the mirror substrates 18, 22 respectively as aforesaid are coated with identical precision multilayer coatings 20, 24. The mirror substrates 18, 20 must be polished to an ultra-smooth finish prior to the application of the multilayer coatings. In the preferred embodiment the mirror substrates 18, 20 are of Hemlite Grade Sapphire, a stable material capable of receiving an ultra-smooth surface finish, which is polished by Advanced Flow Polishing or Ion Polishing methods capable of producing ultra-smooth surfaces to an RMS surface smoothness of 0.5 to 3 angstroms. Other materials deemed suitable for the mirror substrates, but which do not yield as high a polished surface as has been achieved on Sapphire, are Fused Silica and Zerodur. These materials have lower coefficients of expansion than Sapphire and would be preferred for applications where the optics may be subjected to significant thermal loadings.

In the preferred embodiment, the multilayer coating to be utilized on the mirror will be a Tungsten/Silicon multilayer with a 2D of 36 angstroms. This is well within the "water window" but of a significantly long wavelength that the required coatings can now be produced. The multilayer operates as a synthetic Bragg crystal, reflecting x-rays by diffraction in accordance with the Bragg relation: $n(\lambda)=2D\mathrm{Sin}(\phi)$, where n is the order of diffraction, $\lambda$ is the wavelength at which peak reflectivity occurs, D is the sum of the thickness of each of the high-Z diffractor layers in the stack plus the thickness of each of the low-Z spacer layers of the coating, and $\phi$ is the angle at which the radiation strikes the surface of the multilayer. Since the preferred form of the microscope is designed to operate at normal incidence, $\sin(\phi)=1$ and the Bragg relation reduces to the case in which the wavelength at which peak reflectivity by first order diffraction occurs is equal to the 2D parameter of the multilayer coating. Consequently, for this preferred embodiment of the microscope, the peak reflectivity will occur at an x-ray wavelength of 36 angstroms. With an appropriately configured Tungsten/Silicon multilayer, bandpass can be made sufficiently narrow such that a multilayer situated to peak at 36 angstroms should have a transmission which is a very small fraction of one percent for wavelengths longer than 43.7 angstroms and shorter than 23.3 angstroms. The multilayer coatings 20, 24 of both the primary and secondary mirrors 18,22 respectively must be very precisely matched to the same wavelength or greatly reduced system reflection efficiency will result. For this reason, it is preferred that both mirrors be coated at the same time. By sizing the secondary mirror and the annulus or aperture 26 of the primary mirror appropriately, the secondary mirror may be mounted within the aperture in the center of the primary mirror during the application of the multilayer coating to ensure very accurate bandpass matching of the primary and secondary optics. Under ideal conditions, a Tungsten/Silicon multilayer should be capable of yielding a normal incidence reflection efficiency of five to ten percent or more in this wavelength regime. Alternately, different multilayer coatings such as $WB_4C$, Mo/Si, or other coatings may be utilized and other 2D spacings selected to operate at other wavelengths in the "water window." Any of these or other appropriate multilayer coatings capable of producing the required narrow biologically important wavelength may be utilized. Shorter wavelengths yield higher contrast but it is more difficult to produce coatings for them. The important characteristics to be sought in any such multilayer coating is high reflectivity at the selected narrow bandpass within the 23.3 to 43.7 angstroms defining the "water window" with very low reflectivity outside of this wavelength range. Other important features of the coating include long term stability and the ability of the coating to be applied to a highly curved substrate with excellent bandpass matching for the primary and secondary mirrors Although any system magnification within a wide range can be selected, it is preferred that the microscope have a magnification of 25× and the convex secondary mirror substrate preferably has a radius of curvature of 8 cm. These parameters of magnification and substrate curvatures are dictated by the current state-of-the-art for fabricating precision multilayer coatings of the required low 2D spacing on curved surfaces and the desire to maintain the overall system length at a reasonable value for convenient instrument implementation. At a magnification of 25×, when the Schwarzchild condition is imposed, the primary mirror substrate 18 has a radius of curvature such that the resultant system length, i.e., the distance from the object plane to the image plane, can be maintained at less than two meters. Alternately, systems with higher or lower magnifications may be constructed with microscope magnifications in the range of 20× to 30×. High resultant image magnifications, i.e., several thousand diameters, can be achieved by enlarging images recorded on ultra-high resolution photo resists or photographic films which are currently available. It is expected that more compact systems and systems with higher magnifications will be developed as the methods and techniques for fabricating lower 2D multilayer coatings are developed by advanced magnetron sputtering, atomic layer or molecular beam epitaxy methods.

The surface configurations of the concave spherical primary mirror substrate 18 and the convex spherical secondary mirror substrate 22 should be accurate to better than 1/20 wave when tested with visible light. Under these conditions the preferred form of the microscope should have a useful field of view in the order of 1 mm and spatial resolution of better than 100 angstroms over a reasonable field in the object plane. This will permit the instrument to spatially resolve larger molecules, as well as many other ultra-small carbon based structures to be observed within living cells. The microscope can also be applied to investigations of viruses, proteins and protein crystals and a vast array of other microscopic structures outside of living cells. Indeed, although the primary thrust of the present invention lies in its ability to observe with high contrast, carbon based structures in the "water window" the microscope will be quite capable of producing high resolution images of non-carbon based microstructures, such as chemicals and pharmaceuticals, microscopic specimens of minerals and metal alloys. High contrast images of microscopic carbon based structures in living cells and other specimens placed in the object plane of the microscope can be produced in ultra-high spatial resolution and recorded by a suitable detector placed in the image focal plane 46 of the microscope.

The stage end 44 of the mount tube 12 includes an aperture 48 within which the specimen 42 is mounted. The specimen 42 is deposited on the surface of a pre-filter 50 mounted in a filter holder 52 affixed to a movable specimen stage 54 by means of screws 56 or the like. The specimen stage 54 may be driven by any of a number of piezoelectric translator devices 58 which are commercially available. The piezoelectric translator 58 is fastened to the stage end of the mount tube 12 by means of screws 60 or the like. For reasons hereinafter explained the piezoelectric translator should be capable of functioning under vacuum conditions and are connected by wiring 62 to an interface 64. Any of a number of commercially available piezoelectric 3-axis translation devices satisfying these criteria are available and would serve to permit remote focusing and permit different regions of the specimen mount to be centered upon the optical axis.

To illuminate the specimen with x-rays either an x-ray source 66 having a filament 68 and a target 70 may be mounted adjacent the stage end of the microscope, the filament 68 being fed by wiring 72 to an appropriate interface 74, or other suitable high intensity x-ray sources such as laser plasma sources, emission produced in laser fusion experiments at the University of Rochester's OMEGA Facility or the Lawrence Livermore National Laboratory's NOVA Facility or Synchrotron storage rings may be utilized. In the case of the Synchrotron, mounting tube 12 would be mounted within a vacuum chamber attached to the Synchrotron beam line.

In the preferred embodiment in order to detect the image at the image focal plane 46 a detector in the form of a photographic film 76 is fed from a standard film cassette 78 mounted in a camera body 80, the camera conventionally having an internal motor drive 82. A remote adapter 84 may be utilized connected through electrical wiring 86 to an interface 88 so that exposures and film advance can be remotely operated. Conventional 35 mm or 70 mm film cameras with internal drive are suitable, examples being the Cannon T-70 35 mm camera and the Pentax 645 70 mm camera, both of these cameras being capable of operating in a vacuum environment as hereinafter described.

The camera 80 includes a conventional lens T-mount 90 to which an adapter interface 92 is connected, the interface also being connected to a flange 94 at one end of a camera mounting tube 96 by conventional means such as screws or the like (not illustrated). The other end of the camera mounting tube 96 includes a mounting flange 98 which is secured by screws or the like 100 to the image end 34 of the microscope mounting tube 12.

Figure 3:
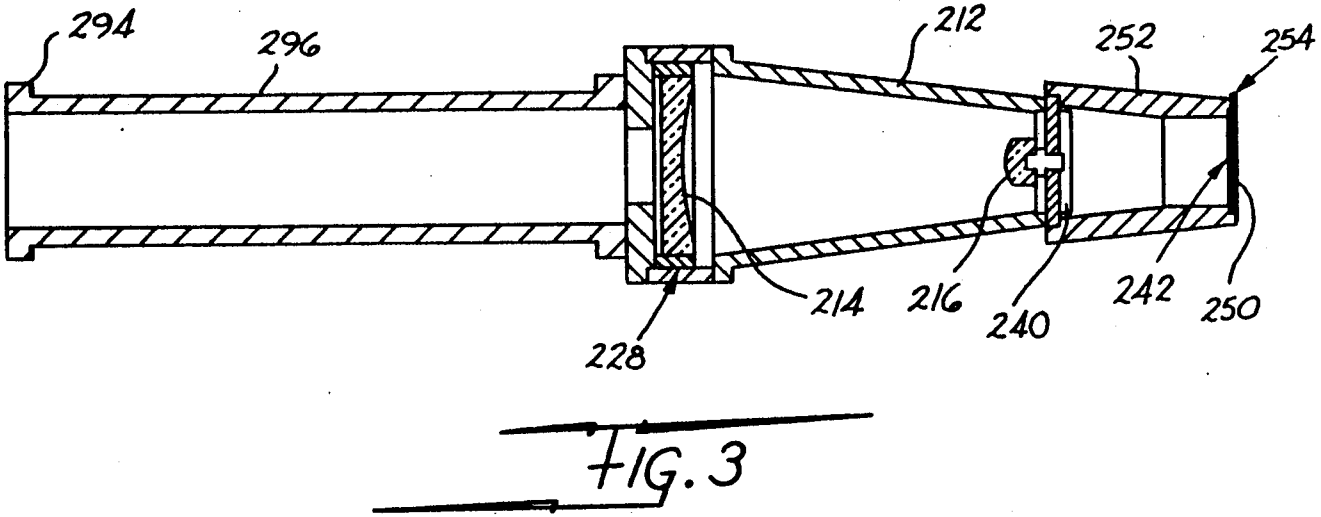
FIG. 3 is a diagrammatic view of another embodiment of the microscope.
Figure 2:
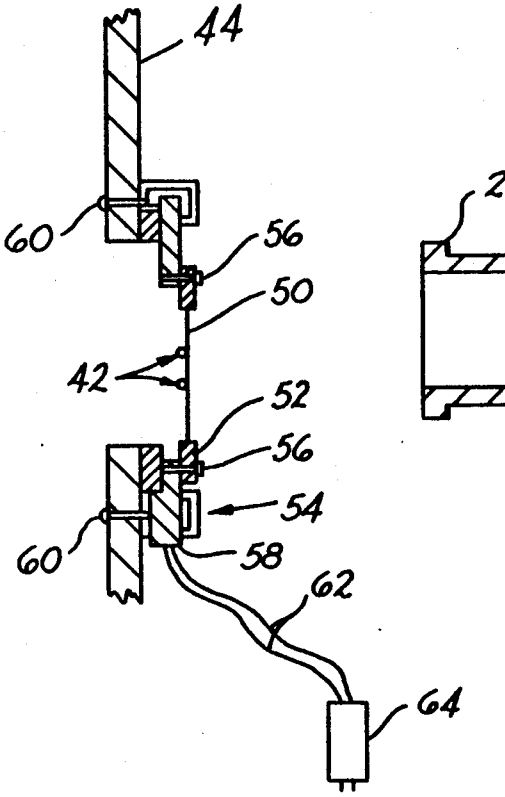
FIG. 2 is a fragmentary enlargement of the stage end of the microscope illustrated in FIG. 1.

The detector film 76 preferably comprises a photographic emulsion such as type 649 produced by Eastman Kodak Company of Rochester, New York without a gelatin overcoat and deposited upon an anti-static backing which is suitable for vacuum operation. X-Ray test measurements on this film have shown it to be sensitive to x-rays in the 23.3 to 43.7 angstrom wavelength range and have a measured spatial resolution in the order of 2000 line pairs per mm. This ultra-high resolution allows great enlargements of the resultant images produced photographically yielding effective magnifications of several thousand diameters. The aforesaid type 649 photographic film affords ultra-high spatial resolution, (although it has reduced sensitivity as compared to traditional emulsions such, as 101-07 or the newer XUV 100 Tabular Grain film), when used with Synchrotron beam or the very bright pulsed sources, such as emissions produced when the 24 beam of UV (3510 angstrom) light converge on the target and laser fusion OMEGA Facility. A water window imaging x-ray microscope designed for use with a laser fusion facility must not interfere with the laser beams which converge on the pellet which they implode. The microscope will actually be mounted into the spherical cavity on the laser fusion device when it is desired to perform studies of the fusion event itself, or to obtain maximum illumination on the specimen. A water window imaging microscope to be used with this type of source, must have a conical exterior structure such that the converging beams can reach the pellet (which is to be imploded to produce the the fusion reaction). Instruments placed within the spherical chamber of the OMEGA facility are not permitted to obstruct the laser beams. FIG. 3 shows a water window imaging x-ray microscope of a conical configuration for use with this facility. The camera (not shown) mounts to camera tube 296 at mount flange 294. The primary reflector 214 is mounted in primary mirror mounting cell 228 and is attached to imaging end baseplate 234 by means of screws (not shown). The filament wound graphite cone 212 forms the stable optical bench that establishes and maintains the separation and alignment of the secondary reflector 216 to the primary reflector 214. Graphite epoxy is used in the preferred embodiment because it can be made with near zero coefficient of expansion, and it is very strong and lightweight. The secondary reflector 216 is mounted on spiders 240. A filter mount cone 252, constructed in the preferred embodiment of low carbon stainless steel is mounted to the end of graphite cone 212 by screws (not shown). The specimen 242 is deposited on the surface of a filter 250 affixed to a specimen mount stage 254 attached to the end of filter mount cone 240 by means of screws or the like The reduced film sensitivity poses no problem even when extremely high time resolution images are desired since the x-ray pulse produced is so brilliant. If the specimen is illuminated at the energy level and burst times utilized at the OMEGA Facility, images can be recorded with a microscope according to the present invention as though the specimen was illuminated by an intense x-ray strobe light. With high repetition rate laser plasma sources successive frames recorded with successive pulses should permit time varying processes within a living cell to be captured in the images so that direct imaging of the most fundamental and crucial of all life processes, the actual replication of DNA molecules in situ and reveal the processes of information transfer via the messenger RNA. This may even permit multiple images recorded by successive rapid pulses from high intensity laser plasmas to record ultra-high resolution motion pictures of these life processes. The XUV 100 emulsion although offering higher sensitivity than the type 649 emulsion, has a lower spatial resolution in the order of approximately 200 line pairs per mm. and would be preferred where the higher sensitivity is required such as for small, self-contained systems designed to operate with lower intensity x-ray sources. Photographic film as the detector offers a vast information storage capability and spatial resolution capability that appear to far exceed other detector means. However, alternate two dimensional imaging detectors that may provide direct, real-time images without photographic processing may include position sensitive proportional counters, charge coupled devices (CCD's) or Multi-Anode Microchannel Array's.

Referring again to FIG. 1, the normal incidence multilayer coated mirrors 18, 22 are also capable of effectively reflecting visible light radiation. Since this could constitute a highly undesirable source of photons upon the detector, particularly when synchrotron, laser plasmas and other sources which produce bright fluxes of visible light are used to illuminate the specimen being investigated by the microscope. Therefore, to remove unwanted radiation, one or more thin foil x-ray filters preferably are mounted in the optical path. Such filters not only remove unwanted visible light, but also further reduce the system transmission of photons at wavelengths which lie outside of the natural bandpass. Several chemical elements have suitable L and M series absorption edges for utilization in such filters. These include the L edges of vanadium, titanium and scandium, and the M edges of tin and indium. For a system designed for use with the OMEGA Facility, the filter 50 upon which the specimen is deposited may be a prefilter comprising a five mm diameter foil of unsupported titanium of 1500 angstrom thickness, or fail supported upon a nickel mesh. The x-ray transmission of this filter is expected to exceed 60 percent. Also, immediately in front of the camera 80 is a camera x-ray filter 102, which in the preferred embodiment comprises a composite of 1500 angstroms of tin with 500 angstroms of aluminum also supported upon a nickel mesh, the x-ray transmission of this filter being expected to exceed 50 percent in the "water window" wavelength band.

Since air becomes very absorptive of x-rays above 20 angstroms, in order to reduce such absorption which would reduce the flux from the source and weaken the intensity of the image reaching the detector with acceptable exposure times, the entire microscope apparatus should be placed in a vacuum. This is true whether or not the microscope is used in conjunction with a synchrotron facility or laser fusion facility such as OMEGA, or used with a self-contained x-ray source such as illustrated at 66. Accordingly, the apparatus as heretofore described should be mounted within a vacuum chamber 104 equipped with appropriate vacuum valves such as 106 connected to one or more vacuum pumps 108 to allow the system to be evacuated prior to operation. The vacuum drawn may be in the order of $10^{-3}$ or $10^{-4}$ torr, and preferably is $10^{-6}$ to $10^{-8}$ torr for use in conjunction with a synchrotron facility. The chamber 104 includes a camera access port and specimen stage access ports at respective ends of the chamber are provided and closed by respective vacuum plates 110, 112 connected in sealed relationship with the chamber 104 by means of bolts 114 or the like. For use with external sources of radiation, such as synchrotrons, vacuum plate 112 contains a port 160 that terminates in a standard varian conflat flange 170. A high vacuum gate valve 180 is mounted to flange 170 by varian screws 172. To achieve a good seal, conventional copper gaskets 194 are used at all mating surfaces in accordance with standard high vacuum practices. Many types of high vacuum gate valves are commercially available and a simple mechanical valve is herein depicted to illustrate the principle only. Gate valve 180 contains a gate 190 which can be opened and closed by rotating lever 192. Outer surface of gate valve 180 is configured as a standard high vacuum conflat flange 196. This flange serves as the mount surface for the purpose of mounting the microscope vacuum chamber 104 to the vacuum chamber which constitutes a part of the synchrotron beam line (not shown). A thin foil x-ray window 198 prevents contamination of the synchrotron beam line by residual gases in chamber 104. This is necessary since synchrotrons must operate at ultra-high vacuum. To prevent thin foil window 198 from rupturing, gate 190 is only opened after a good vacuum (less than $10^{-3}$ torr) is achieved in the microscope chamber 104 and the synchrotron beam line on the other side of the gate valve is under high vacuum. Obviously, prior to use with a synchrotron source, small internal source 66 must be removed or it would block the radiation from the synchrotron beam (not shown) The microscope housing 12 may be supported by V-blocks 116, 118 mounted on the base of the vacuum chamber 104 such that the microscope is at the appropriate level for receiving x-rays from the source. The interfaces 64, 74, and 88 feed the required voltage sources through the chamber while maintaining a tight seal to preclude loss of vacuum.

Accordingly, a double reflection microscope transmitting x-rays in the "water window" x-ray band of 23.3 to 43.3 angstroms is disclosed which images on the detector carbon structures in the specimen in high contrast. X-Rays within that bandpass will be reflected by the coatings 20, 24 on the mirrors 18, 22, while x-rays outside of that bandpass will not be reflected. The ultra-smooth polished mirror substrates 18, 22 with the multilayer coatings focus and image the x-rays in the narrow bandpass onto the detector 76. Additionally, in order to avoid undesirable light radiation the thin foil x-ray filters 50 and 102 utilized at the specimen stage and the camera ensure that only transmission at the desired wavelengths is received by the detector. Accordingly, a high resolution microscope capable of operating in the "water window" is disclosed which opens new horizons to research in the area of microbiology.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An x-ray microscope for high resolution imaging in a narrow band at wavelengths where x-rays are absorbed by carbon and for which water within biological specimens or the like is transparent so that microscopic structures within said specimens which are carbon based may be imaged with high contrast, said microscope comprising: a hollow mounting tube having a stage end and an image end at respective ends of said tube, filter means mounted at an object plane disposed adjacent said stage end for carrying a specimen to be illuminated by an x-ray source having a range of wavelengths including wavelengths within said band, primary and secondary normal incidence mirror substrates disposed within said mounting tube, each of said mirror substrates having an ultra-smooth mirror surface finish, an identical multilayer coating carried on the mirror surfaces of said primary and secondary substrates for reflecting with high efficiency radiation within said narrow band while providing low reflectivity outside of said band, first mounting means for positioning said primary mirror substrate for receiving radiation transmitted through a specimen mounted on said filter means and for reflecting radiation to said secondary mirror substrate, second mounting means for positioning said secondary mirror substrate for receiving radiation from said primary mirror substrate and for reflecting said radiation to an image plane adjacent said image end, and an x-ray detector sensitive to wavelengths within said band disposed at said image plane.

2. A x-ray microscope as recited in claim 1, wherein said primary mirror comprises a concave spherical surface and said secondary mirror comprises a convex spherical surface said spherical surfaces having a common center of curvature disposed intermediate said stage end and said secondary mirror.

3. An x-ray microscope as recited in claim 2, wherein said primary mirror has an annular configuration with a central aperture, said secondary mirror being disposed intermediate said primary mirror and said center of curvature for reflecting radiation through said aperture to said detector.

4. An x-ray microscope as recited in claim 3, wherein said primary and secondary mirrors define an optical system having an optical axis, said optical axis passing through said aperture, and said center of curvature being disposed on said optical axis.

5. An x-ray microscope as recited in claim 1, wherein said multilayer coating has a high reflectivity in a wavelength band between 23.3 and 43.7 angstroms and a low reflectivity outside said wavelength band.

6. An x-ray microscope as recited in claim 5, wherein said mirror substrates each have a surface smoothness in the order of 0.5 to 3 angstroms RMS.

7. An x-ray microscope as recited in claim 6, wherein said coating reflects x-rays by diffraction in accordance with the Bragg relation and the wavelength at which peak reflectivity by first order diffraction occurs is approximately 36 angstroms.

8. An x-ray microscope as recited in claim 7, wherein said primary mirror comprises a concave spherical surface and said secondary mirror comprises a convex spherical surface, said spherical surfaces having a common center of curvature disposed intermediate said stage end and said secondary mirror.

9. An x-ray microscope as recited in claim 8, wherein said primary mirror has an annular configuration with a central aperture, said secondary mirror being disposed intermediate said primary mirror and said center of curvature for reflecting radiation through said aperture to said detector.

10. An x-ray microscope as recited in claim 9, wherein said primary and secondary mirrors define an optical system having an optical axis, said optical axis passing through said aperture, and said center of curvature being disposed on said optical axis.

11. An x-ray microscope as recited in claim 1, wherein said filter means comprises a foil of titanium supported on a nickel mesh for preventing visible light radiation to be transmitted from said source to said primary and secondary mirror substrates.

12. An x-ray microscope as recited in claim 1, wherein said detector comprises photographic film.

13. An x-ray microscope as recited in claim 4, wherein the radius $R_1$ of the primary mirror substrate, the radius $R_2$ of the secondary mirror substrate and the distance $Z_0$ from the center of curvature to the specimen conforms to the equation $R_2/R_1 = 1.5 - R_2/Z_0 \pm (1.25 - R_2/Z_0)^{\frac{1}{2}}$.

14. Apparatus for imaging microscopic structures within biological specimens comprising, a vacuum chamber and means for mounting an x-ray microscope mounted within said chamber, said microscope comprising a hollow mounting tube having a stage end and an image end at respective ends of said tube, filter means mounted at an object plane disposed adjacent said stage end for carrying a specimen to be illuminated by an x-ray source having a range of wavelengths including wavelengths within a narrow band where x-rays are absorbed by carbon and not absorbed by water within said specimens, primary and secondary normal incidence mirror substrates disposed within said mounting tube, each of said mirror substrates having an ultra-smooth mirror surface finish, an identical multilayer coating carried on the mirror surfaces of said primary and secondary substrates for enhancing the reflectivity of radiation within said narrow band while providing low reflectivity outside of said band, first mounting means for positioning said primary mirror substrate for receiving radiation transmitted through a specimen mounted on said filter means and for reflecting radiation to said secondary mirror substrate, second mounting means for positioning said secondary mirror substrate for receiving radiation from said primary mirror substrate and for reflecting said radiation to an image plane adjacent said image end, and an x-ray detector sensitive to wavelengths within said band disposed at said image plane.

15. Apparatus as recited in claim 14, wherein said primary mirror comprises a concave spherical surface and said secondary mirror comprises a convex spherical surface, said spherical surfaces having a common center of curvature disposed intermediate said stage end and said secondary mirror.

16. Apparatus as recited in claim 15, wherein said primary mirror has an annular configuration with a central aperture, said secondary mirror being disposed intermediate said primary mirror and said center of curvature for reflecting radiation through said aperture to said detector.

17. Apparatus as recited in claim 16, wherein said primary and secondary mirrors define an optical system having an optical axis, said optical axis passing through said aperture, and said center of curvature being disposed on said optical axis.

18. Apparatus as recited in claim 14, wherein said multilayer coating has a high reflectivity in a wavelength band between 23.3 and 43.7 angstroms and a low reflectivity outside said wavelength band.

19. Apparatus as recited in claim 18, wherein said mirror substrates each have a surface smoothness in the order of 0.7 to 3 angstroms RMS.

20. Apparatus as recited in claim 19, wherein said coating reflects x-rays by diffraction in accordance with the Bragg relation and the wavelength at which peak reflectivity by first order diffraction occurs is approximately 36 angstroms.

* * * * *